US009258652B2

(12) United States Patent
Wang

(10) Patent No.: US 9,258,652 B2
(45) Date of Patent: Feb. 9, 2016

(54) MICROPHONE STRUCTURE

(71) Applicant: Chuan-Wei Wang, Taoyuan (TW)

(72) Inventor: Chuan-Wei Wang, Taoyuan (TW)

( * ) Notice: Subject to any disclaimer, the term of this patent is extended or adjusted under 35 U.S.C. 154(b) by 0 days.

(21) Appl. No.: 14/245,558

(22) Filed: Apr. 4, 2014

(65) Prior Publication Data

US 2014/0217522 A1 Aug. 7, 2014

Related U.S. Application Data

(63) Continuation-in-part of application No. 13/679,322, filed on Nov. 16, 2012, now Pat. No. 8,828,771.

(30) Foreign Application Priority Data

Nov. 18, 2011 (TW) ..... 100142335 A

(51) Int. Cl.
*H04R 19/00* (2006.01)
*H04R 19/04* (2006.01)
*H04R 31/00* (2006.01)

(52) U.S. Cl.
CPC ..... *H04R 19/005* (2013.01); *H04R 19/04* (2013.01); *H04R 31/00* (2013.01)

(58) Field of Classification Search
CPC .... H04R 19/005; H04R 19/04; H04R 17/025; H04R 17/10; H04R 31/00; H04R 31/003; H04R 19/01; H04R 19/016; G01P 151/125
See application file for complete search history.

(56) References Cited

U.S. PATENT DOCUMENTS 7,621,183 B2 11/2009 Seeger et al.
7,912,235 B2 * 3/2011 Chen ..... 381/174
8,436,435 B2 * 5/2013 Chan et al. ..... 257/416
8,637,945 B2 * 1/2014 Reichenbach et al. ..... 257/416
2007/0058825 A1 * 3/2007 Suzuki et al. ..... 381/174
2008/0031476 A1 * 2/2008 Wang et al. ..... 381/174
2008/0123876 A1 * 5/2008 Sato et al. ..... 381/174
2009/0026561 A1 * 1/2009 Reichenbach et al. ..... 257/416
2009/0067033 A1 3/2009 Kajino et al.
2009/0154735 A1 * 6/2009 Kim et al. ..... 381/190
2009/0208037 A1 * 8/2009 Zhe ..... 381/174
2009/0317931 A1 12/2009 Perruchot et al.

OTHER PUBLICATIONS

Graham et al., "Wafer Scale Encapsulation of Large Lateral Deflection Mems Structures", Micro Electro Mech. Sys., 2009, IEEE 22nd International Conference on, Jan. 25-29, 2009, pp. 745-748.

* cited by examiner

*Primary Examiner* — Fan Tsang
*Assistant Examiner* — Angelica M McKinney
(74) *Attorney, Agent, or Firm* — Muncy, Geissler, Olds & Lowe, P.C.

(57) ABSTRACT

A microphone structure is disclosed. The microphone structure comprises a substrate penetrated with at least one opening chamber and having an insulation surface. A conduction layer is arranged on the insulation surface and arranged over the opening chamber. An insulation layer is arranged on the conduction layer and having a opening to expose a part of the conduction layer as a vibration block arranged over the opening chamber. At least two first patterned electrodes are arranged on the insulation layer and arranged over the vibration block. At least two second patterned electrodes are arranged over the opening chamber, arranged on the vibration block and separated from the first patterned electrodes by at least two first gaps. When the vibration block vibrates, the vibration block moves the second patterned electrodes whereby the second patterned electrodes and the first patterned electrodes perform differential sensing.

11 Claims, 9 Drawing Sheets

MICROPHONE STRUCTURE

RELATED APPLICATIONS

The present invention is a continuous-in-part application of the application that is entitled "Sensor Manufacturing Method And Microphone Structure Made By Using The Same" (U.S. application Ser. No. 13/679,322), which is filed presently with the U.S. Patent & Trademark Office, and which is used herein for reference in its entirety.

BACKGROUND OF THE INVENTION

1. Field of the Invention

The present invention relates to a Micro Electro-Mechanical System (MEMS) structure, and in particular to a microphone structure.

2. The Prior Arts

In the past thirty years, the complementary metal oxide semiconductor (CMOS) has been used extensively in the manufacturing of Integrated Circuits (IC). The development and innovation of IC have progressed by leaps and bounds, due to huge amount of research manpower and investment put in, to raise significantly its reliability and yields; meanwhile, its production cost is reduced drastically. Presently, that technology has reached a mature and stable level, such that for the continued development of the semiconductor, in addition to keeping up the present trend of technical development, it is essential to achieve breakthrough to provide special production process, and enhance system integration of high concentration.

In this respect, the Micro Electro-Mechanical System (MEMS) is a new processing technology completely different from the convention technology. It mainly utilizes the semiconductor technology to produce MEMS structure; meanwhile it is capable of making products having electronic and mechanical functions. As such, it has the advantages of batch processing, miniaturization, and high performance, and is very suitable for use in Production Industries requiring mass production at reduced cost. Therefore, for this stable and progressing CMOS technology, the integration of MEMS and circuitry can be a better approach to achieve system integration.

For the processing of most of the MEMS elements, polysilicon is utilized to make active elements, such that it utilizes one or more oxides as the release layer, the silicon nitride as the isolation layer, and metal layer as a reflector and internal connection. In processing the MEMS elements, it could encounter an especially difficult release problem, such that in this process, a silicon oxide sacrifice layer is dissolved, and a gap thus created is to separate various elements. In this respect, the MEMS elements, including the electrostatic suspension arms, the deflection mirrors, and the torsion regulator are released through dissolving the sacrifice layer by means of the wet chemical process. In general, that process is performed on a single piece of MEMS circuit chip, rather on a whole wafer. At this time, the static friction is liable to cause decrease of yield. The static friction refers to two adjacent surfaces stick to each other, as caused by the capillary forces produced by drying up the liquid between two micro-structures, thus leading to decrease of yield. Most of the MEMS elements are made through using oxide sacrifice layers. Usually, a water containing hydrofluoric acid is used to dissolve an oxide sacrifice layer to achieve release. In another approach, a hydrofluoric acid vapor is used to release MEMS elements having oxide sacrifice layer.

In a thesis of Stanford University, "Wafer Scale Encapsulation Of Large Lateral Deflection MEMS Structure", the MEMS element is produced by first performing Deep Reactive-Ion Etching of a silicon-on-insulator (SOI) substrate. Next, grow a layer of silicon dioxide thereon, and then planarize its surface. Subsequently, form a first epitaxy layer, and then perform deep reactive-ion etching to remove a part of the silicon layer. Finally, grow a second epitaxy layer to seal off the etched holes on the first epitaxy layer, to form an electrode serving as a connection pad. In addition, in U.S. Pat. No. 7,621,183, another MEMS element manufacturing method is disclosed. Wherein, firstly, form an oxide layer on a cap wafer, then form a balance structure and a germanium layer on a gyroscope wafer, to connect the gyroscope wafer onto the cap wafer. Finally, connect a reference wafer electrically to the germanium layer, to fix it on the gyroscope wafer. From the descriptions above it can be known that, the former cited case utilizes the epitaxy technology requiring high price metal; while for the latter cited case, its production process is rather complicated.

In the traditional technology, a microphone structure fabricated by MEMs technology comprises two electrode plates, and a insulation material is arranged between the electrode plates. However, the distance between the electrode plates is fixed. If the developer wants to greatly increase the capacitance of the microphone structure, the areas of the electrode plates are greatly enlarged, which greatly increases the fabrication cost. Besides, releasing the insulation material is a complicated fabrication process.

In view of the problems and shortcomings of the prior art, the present invention provides a microphone structure, that is simple in implementation, to overcome the deficiency and drawback of the prior art.

SUMMARY OF THE INVENTION

A major objective of the present invention is to provide a microphone structure, that utilizes the simple process to fabricate at least two first patterned electrodes and at least two second patterned electrodes on a planar plane, wherein a gap exists between the first patterned electrode and the neighboring second patterned electrode. The second patterned electrode moves away from or toward the first patterned electrode, which results in the variation of capacitance, achieving the purpose of low cost of large electrodes.

In order to achieve the above objective, the present invention provides a microphone structure, comprising a substrate, a conduction layer, a insulation layer, at least two first patterned electrodes and at least two electrodes. The substrate is penetrated with at least one opening chamber and has an insulation surface. The conduction layer is arranged on the insulation surface and arranged over the opening chamber. The insulation layer is arranged on the conduction layer and having a first opening to expose a part of the conduction layer as a vibration block arranged over the opening chamber. The first patterned electrodes are arranged on the insulation layer and arranged over the vibration block. The second patterned electrodes are arranged over the opening chamber and arranged on the vibration block. The first and second patterned electrodes are arranged over different regions of a conduction surface of the conduction layer. The first and second patterned electrodes are spaced in a plane parallel to the conduction layer. A first gap exists between the second patterned electrode and the neighboring first patterned electrode. When the vibration block vibrates, the vibration block moves the second patterned electrodes whereby the second patterned electrodes and the first patterned electrodes perform differential sensing.

Further scope of the applicability of the present invention will become apparent from the detailed descriptions given hereinafter. However, it should be understood that the detailed descriptions and specific examples, while indicating preferred embodiments of the present invention, are given by way of illustration only, since various changes and modifications within the spirit and scope of the present invention will become apparent to those skilled in the art from this detailed descriptions.

BRIEF DESCRIPTION OF THE DRAWINGS

The related drawings in connection with the detailed descriptions of the present invention to be made later are described briefly as follows, in which.

DETAILED DESCRIPTION OF THE PREFERRED EMBODIMENT

The purpose, construction, features, functions and advantages of the present invention can be appreciated and understood more thoroughly through the following detailed description with reference to the attached drawings.

Figure 1:
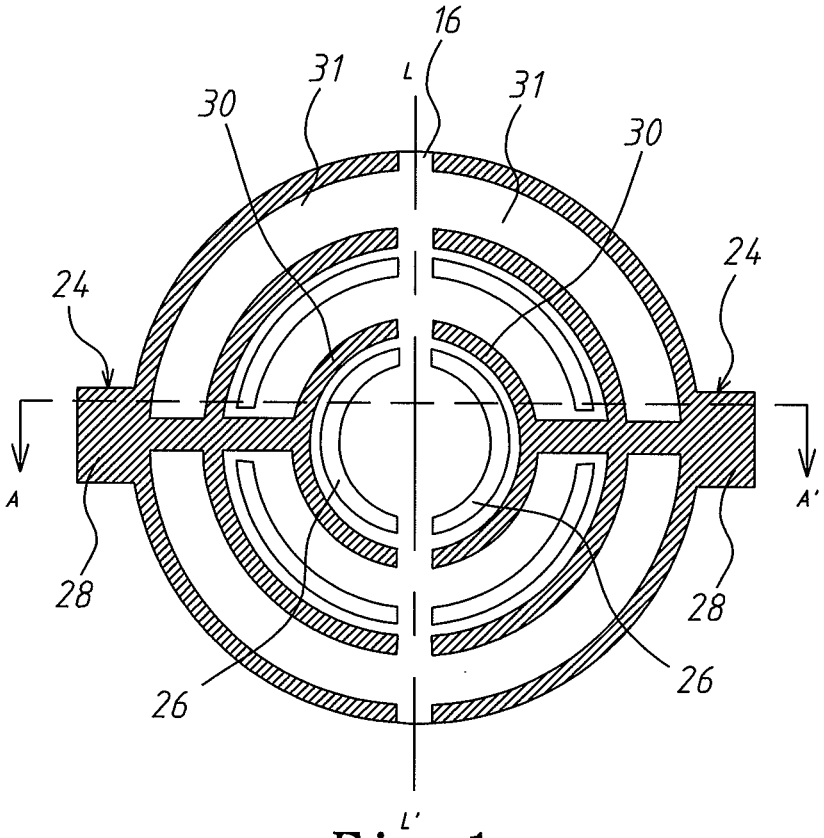
FIG. 1 is a top view schematically showing a microphone structure according to the first embodiment of the present invention.
Figure 2:
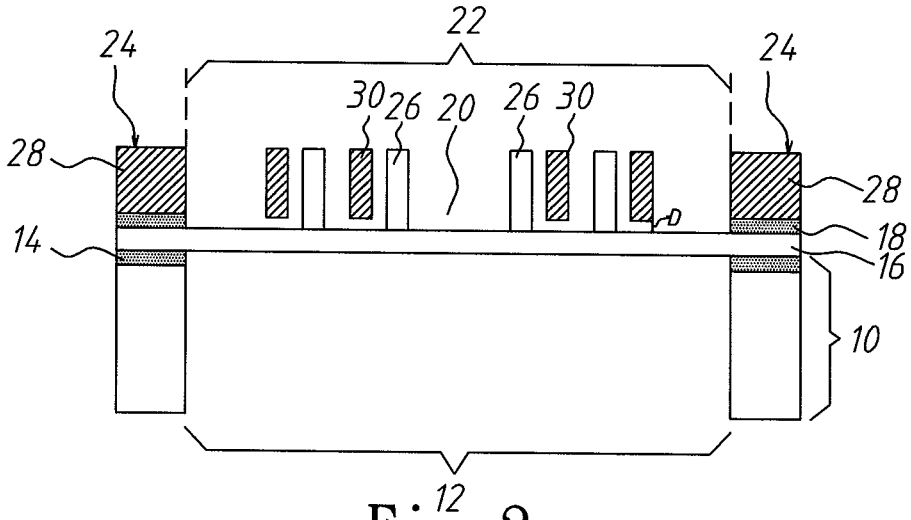
FIG. 2 is a sectional view taken along Line A-A' of FIG. 1 according to the first embodiment of the present invention.
Figure 3A:
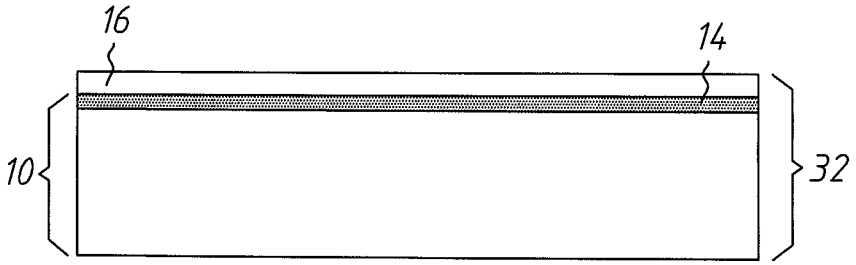
FIGS. 3(*a*) to 3(*f*) are diagrams schematically showing the steps of fabricating a microphone structure according to the first embodiment of the present invention.
Figure 3B:
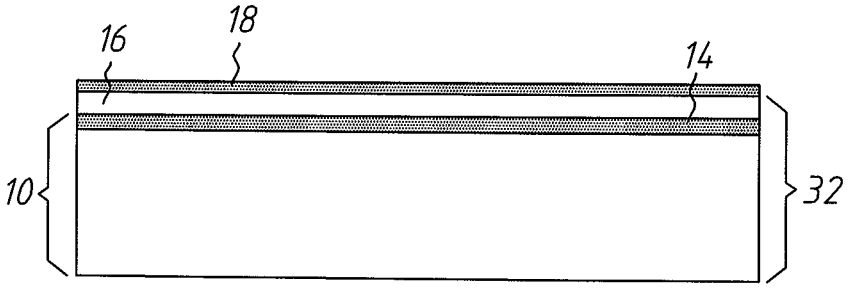
Figure 3C:
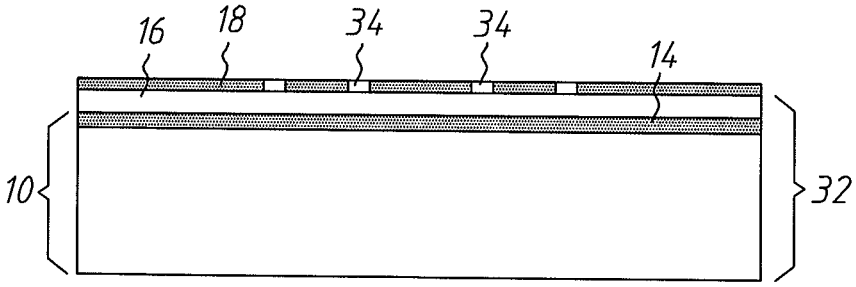
Figure 3D:
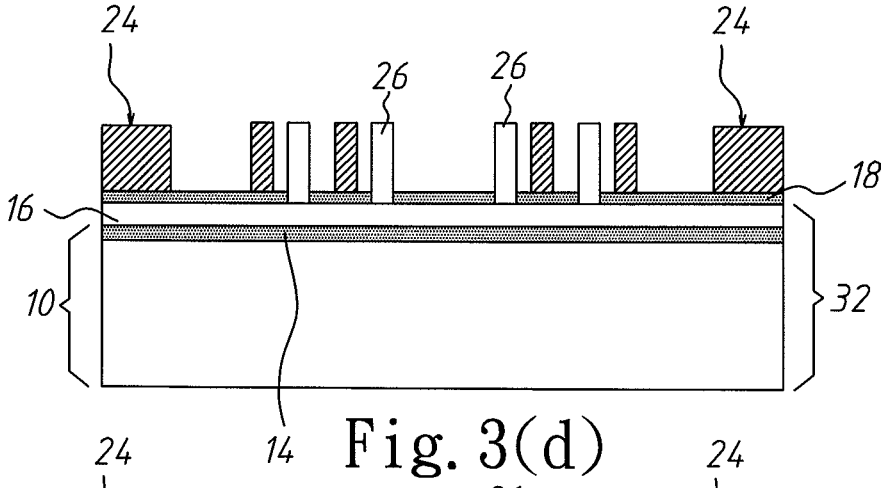
Figure 3E:
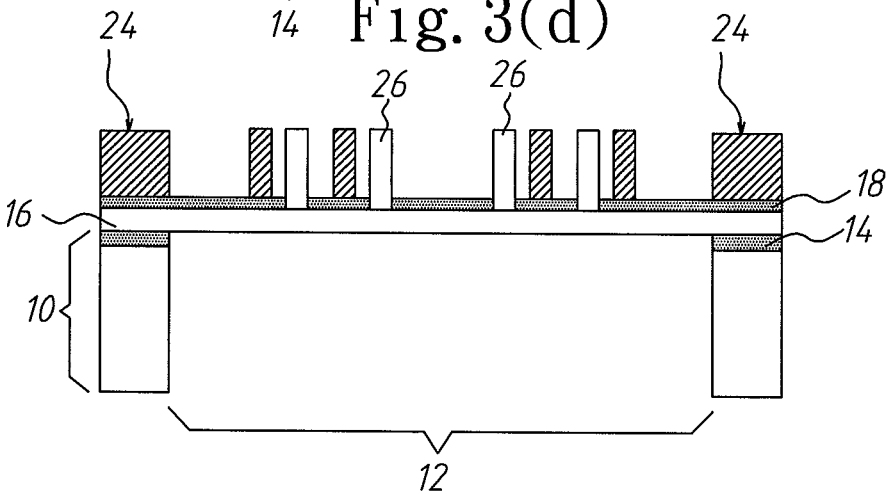
Figure 3F:
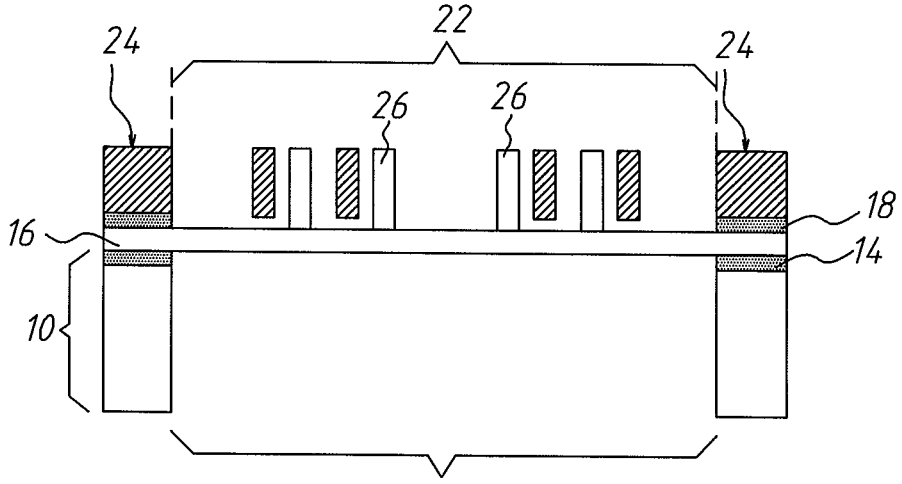

Refer to FIG. 1 and FIG. 2. FIG. 1 is a top view schematically showing a microphone structure according to the first embodiment of the present invention. FIG. 2 is a sectional view taken along Line A-A' of FIG. 1. The first embodiment of the present invention is described below. The first embodiment comprises a substrate 10 penetrated with at least one opening chamber 12 and having an insulation surface 14. A conduction layer 16 is arranged on the insulation surface 14 and arranged over the opening chamber 12. An insulation layer 18 is arranged on the conduction layer 16 and having a first opening 20 to expose a part of the conduction layer 16 as a vibration block 22 arranged over the opening chamber 12. At least two first patterned electrodes 24 are arranged on the insulation layer 18 and arranged over the vibration block 22 and the opening chamber 12. The amount of the first patterned electrodes 24 is two, which is an example. Each first patterned electrode 24 comprises a first electrode block 28 and a second electrode block 30 adjacent to each other. The first electrode block 28 is arranged on the insulation layer 18, and the second electrode block 30 is arranged over the vibration block 22 and the opening chamber 12. Each second electrode block 30 further comprises at least four second openings 31 to expose the vibration block 22. The amount of the second openings 31 is five, which is an example. The first patterned electrodes 24 are symmetrical with a line L-L' being an axis. At least two second patterned electrodes 26 are arranged over the opening chamber 12 and arranged on the vibration block 22. The first and second patterned electrodes 24 and 26 are arranged over different regions of a conduction surface of the conduction layer 16. The first and second patterned electrodes 24 and 26 are spaced in a plane parallel to the conduction layer 16. A first gap exists between the second patterned electrode 26 and the neighboring first patterned electrode 24. The amounts of the second patterned electrodes 26 and the first gaps are respectively six, which is an example. Each second electrode block 30 neighbors the three second patterned electrode 26, and the second patterned electrodes 26 are symmetrical with the axis L-L'. The substrate 10 is exemplified by a silicon substrate.

When the sound pressure applies on the vibration block 22 and the vibration block 22 vibrate up and down, the vibration block 22 moves the second patterned electrodes 26. For example, when the vibration block 22 vibrates up, a distance D between the second electrode block 30 and the conduction layer 16 will be reduced. When the vibration block 22 vibrates down, the distance D between the second electrode block 30 and the conduction layer 16 will be enlarged. The variation of the distance D can affect the capacitance of the microphone. In other words, when the distance D is reduced, the area of the first patterned electrodes 24 or the second patterned electrodes 26 is slightly enlarged, which results in a very large capacitance. The present invention can greatly save the fabrication cost for large area electrodes.

Refer to FIGS. 3(*a*)-3(*f*). The fabrication process of the first embodiment is described below. As shown in FIG. 3 (*a*), a silicon-on-insulation (SOI) substrate 32 is provided. The SOI substrate 32 comprises the substrate 10 and a silicon layer thereon. The silicon layer is used as the conduction layer 16 arranged on the insulation surface 14 of the substrate 10. Then, as shown in FIG. 3(*b*), the insulation layer 18 is formed on the conduction layer 16. Then, as shown in FIG. 3(*c*), a part of the insulation layer 18 is etched to form openings to expose the conduction layer 16. And, conduction material 34, such as silicon or metal, is formed in the openings to electrically connect with the conduction layer 16. Then, as shown in FIG. 3(*d*), the conduction material 34 continues to be deposited to form the second patterned electrodes 26. Meanwhile, the first patterned electrodes 24 are formed on the insulation layer 18 by Inductively Coupled Plasma (ICP). Then, as shown in FIG. 3(*e*), the substrate 10 is etched to have the opening chamber 12. Finally, as shown in FIG. 3(*f*), a part of the insulation layer 18 is released to have the first opening 20 to expose a part of the conduction layer 16 as the vibration block 22. The above-mentioned fabrication process is not only simple but also realizes cost reduction.

Figure 4:
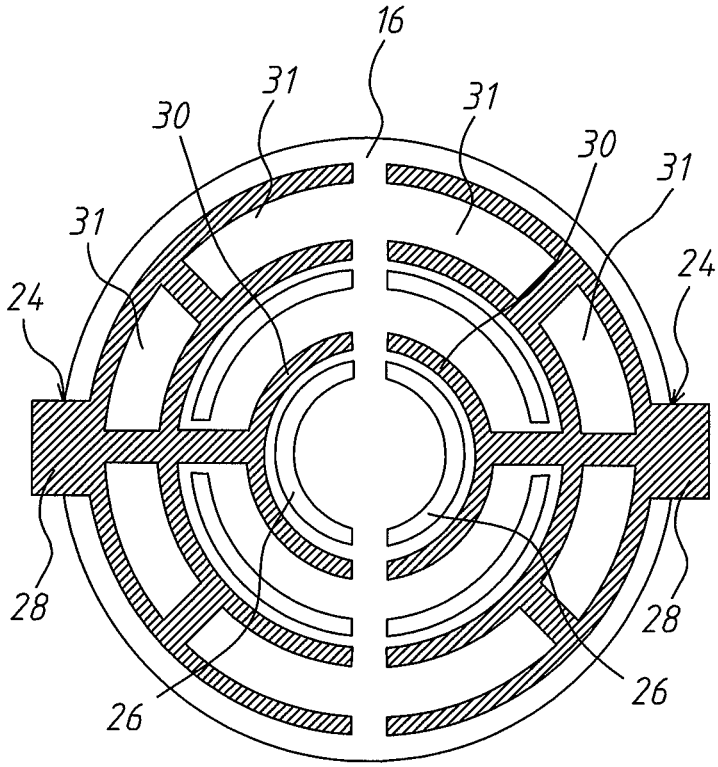
FIG. 4 is a top view schematically showing a microphone structure according to the second embodiment of the present invention.
Figure 5:
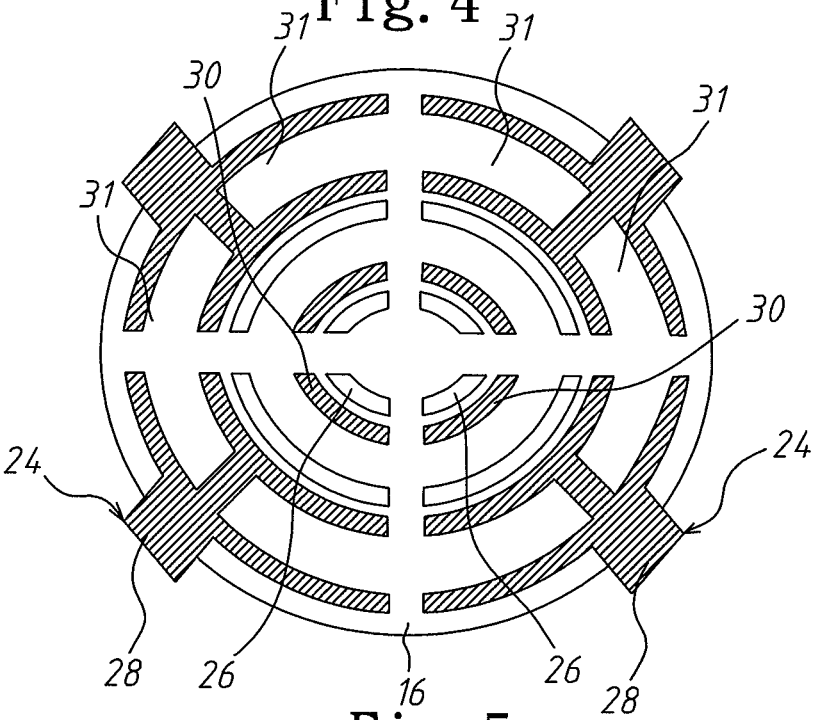
FIG. 5 is a top view schematically showing a microphone structure according to the third embodiment of the present invention.

In order to steady the structure of the microphone, the second and third embodiment of the present invention are described below. Refer to FIG. 4. Compared with the first embodiment, each second electrode block 30 of the second embodiment comprises seven second openings 31. Refer to FIG. 5. Compared with the first embodiment, the amount of the first patterned electrodes 24 of the third embodiment is four.

Figure 6:
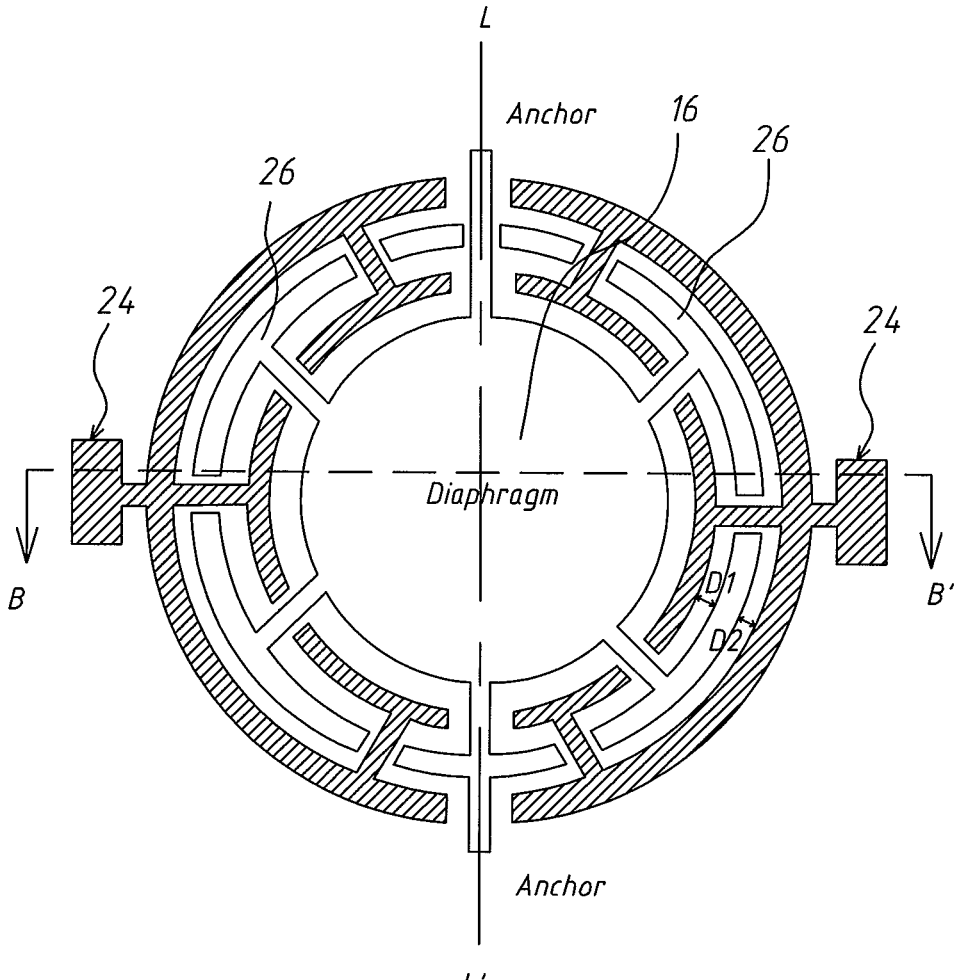
FIG. 6 is a top view schematically showing a microphone structure according to the fourth embodiment of the present invention.
Figure 7:
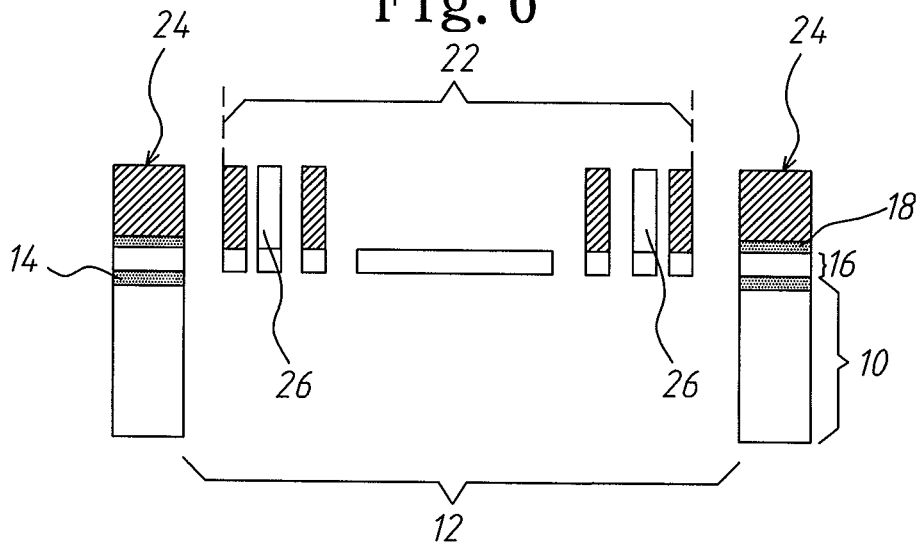
FIG. 7 is a sectional view taken along Line B-B' of FIG. 6 according to the fourth embodiment of the present invention.
Figure 8:
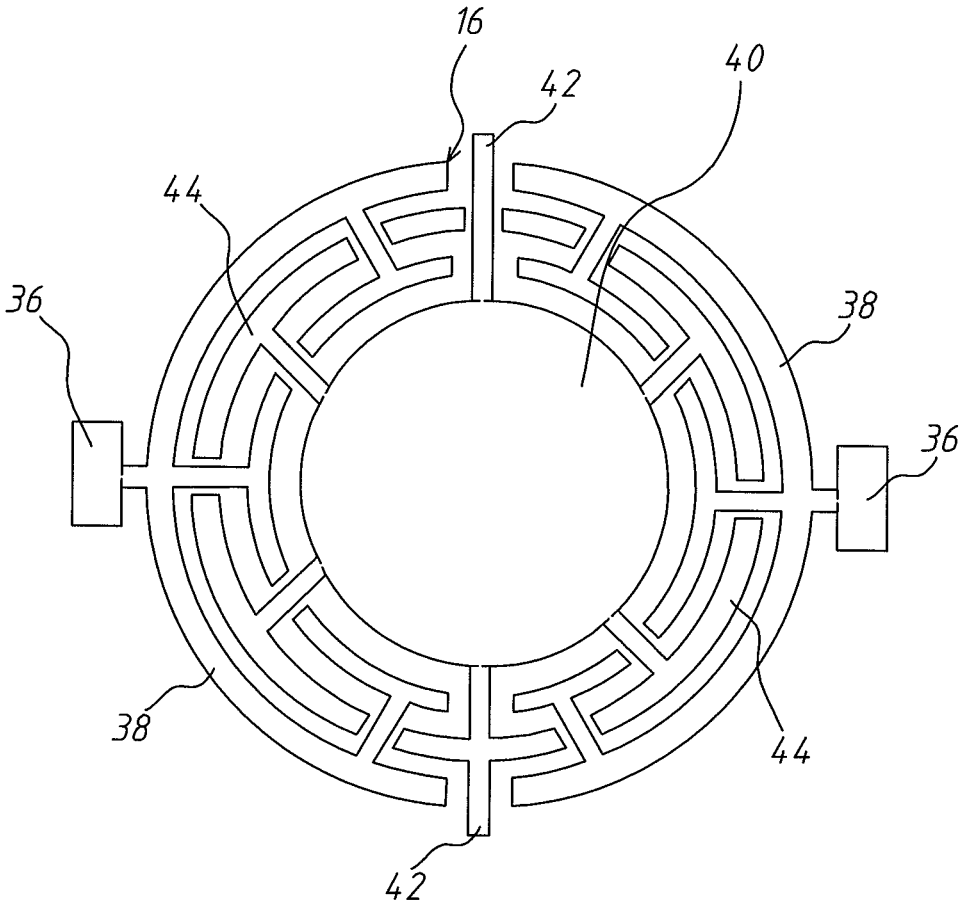
FIG. 8 is a top view schematically showing the conduction layer of a microphone structure according to the fourth embodiment of the present invention.

Refer to FIGS. 6-8. FIG. 6 is a top view schematically showing a microphone structure according to the fourth embodiment of the present invention. FIG. 7 is a sectional view taken along Line B-B' of FIG. 6. The fourth embodiment of the present invention is described below. The fourth embodiment comprises a substrate 10, such as a silicon substrate, penetrated with an opening chamber 12 and having an insulation surface 14. A conduction layer 16 is arranged on the insulation surface 14 and arranged over the opening chamber 12. An insulation layer 18 is arranged on the conduction layer 16 and has a first opening to expose a part of the conduction layer 16 as a vibration block 22 arranged over the opening chamber 12. At least two first patterned electrodes 24 are arranged on the insulation layer 18 and arranged over the vibration block 22 and the opening chamber 12. The amount of the first patterned electrodes 24 is two, which is an example. At least two second patterned electrodes 26 are arranged over the opening chamber 12 and arranged on the vibration block 22. The amount of the second patterned electrodes 26 is two, which is an example. The first and second patterned electrodes 24 and 26 are arranged over different regions of a conduction surface of the conduction layer 16. The first and second patterned electrodes 24 and 26 are spaced in a plane parallel to the conduction layer 16. A first gap D1 or D2 exists between the second patterned electrode 26 and the neighboring first patterned electrode 24. When the vibration block 22 vibrates, the vibration block 22 moves the second patterned electrodes 26 whereby the second patterned electrodes 26 and the first patterned electrodes 24 perform differential sensing.

The conduction layer 16 further comprises at least two first supporting blocks 36 arranged between the insulation surface 14 and the insulation layer 16. The amount of the first supporting blocks 36 is two, which is an example. The vibration block 22 further comprises at least two sensed blocks 38, a diaphragm block 40, at least two second supporting blocks 42 and at least two moved blocks 44. The amounts of the sensed blocks 38, the second supporting blocks 42 and the moved blocks 44 are respectively two, two and two, which is an example. The diaphragm block 40, the second supporting blocks 42 and the moved blocks 44 are adjacent to each other, and the moved blocks 44 and the second supporting blocks 42 are arranged outside the diaphragm block 40, and the second supporting blocks 42 are arranged on the insulation surface 14, and the diaphragm block 40 is arranged over the opening chamber 12, and the first supporting blocks 36 and the sensed blocks 38 are respectively adjacent to each other, and the first supporting blocks 36 are respectively arranged outside the sensed blocks 38, and the moved blocks 44 and the sensed blocks 38 are arranged over the opening chamber 12, and the moved blocks 44 are respectively separated from the sensed blocks 38 by at least one second gap. The sensed blocks 38 are symmetrical with a line being an axis L-L', and the moved blocks 44 are symmetrical with the axis L-L'. The first patterned electrodes 24 are arranged on the insulation layer 18 and the sensed blocks 38, and the second patterned electrodes 26 are arranged on the moved blocks 44. As a result, the first patterned electrodes 24 are symmetrical with the axis L-L', and the second patterned electrodes 26 are symmetrical with the axis L-L'. The diaphragm block 40 vibrates to move the second patterned electrodes 26.

When the sound pressure applies on the diaphragm block 40 and the diaphragm block 40 vibrate up and down, the diaphragm block 40 moves the second patterned electrodes 26. For example, when the diaphragm block 40 vibrates up or down, the first gap D1 will be respectively reduced. The variation of the first gap can affect the capacitance of the microphone. In other words, when the first gap is reduced, the area of the first patterned electrodes 24 or the second patterned electrodes 26 is slightly enlarged, which results in a very large capacitance. The present invention can greatly save the fabrication cost for large area electrodes.

Figure 9:
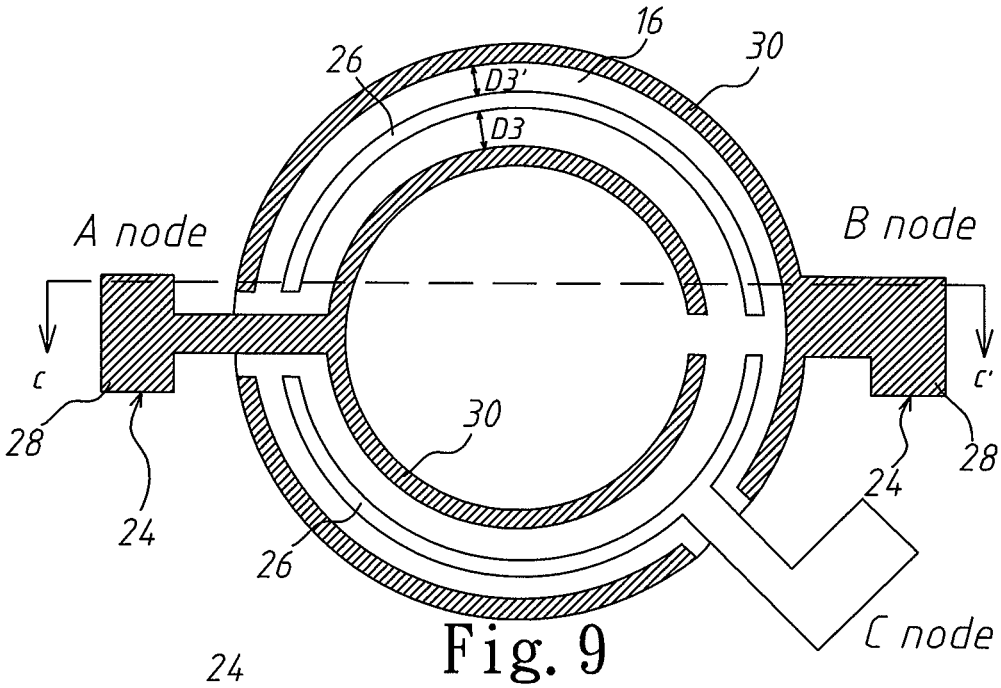
FIG. 9 is a top view schematically showing a microphone structure according to the fifth embodiment of the present invention.
Figure 10:
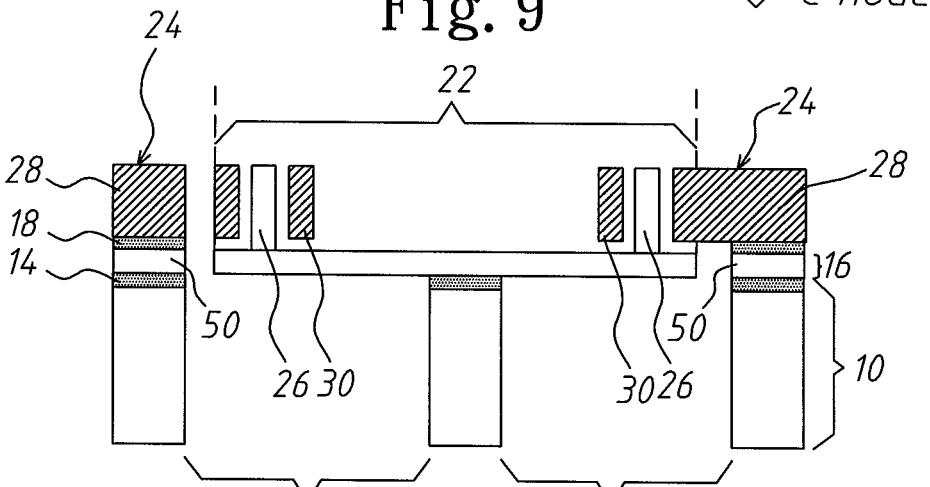
FIG. 10 is a sectional view taken along Line C-C' of FIG. 9 according to the fifth embodiment of the present invention.
Figure 11:
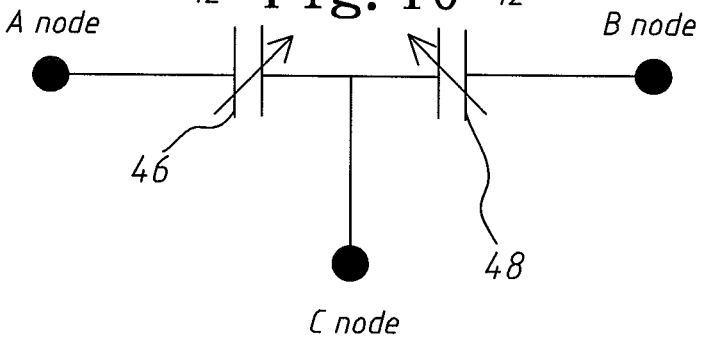
FIG. 11 is an equivalent circuit according to the fifth embodiment of the present invention.

Refer to FIGS. 9-11. FIG. 9 is a top view schematically showing a microphone structure according to the fifth embodiment of the present invention. FIG. 10 is a sectional view taken along Line C-C' of FIG. 9. The fifth embodiment of the present invention is described below. The fifth embodiment is a differential microphone. The fifth embodiment comprises a substrate 10, such as a silicon substrate, penetrated with at least two opening chambers 12 and having an insulation surface 14. The amount of the opening chambers 12 is four, which is an example. A conduction layer 16 is arranged on the insulation surface 14 and arranged over the opening chambers 12. An insulation layer 18 is arranged on the conduction layer 16 and has a first opening to expose a part of the conduction layer 16 as a vibration block 22 arranged over the opening chambers 12 and on the insulation surface 14. At least two first patterned electrodes 24 are arranged on the insulation layer 14 and arranged over the vibration block 22 and the opening chambers 12. The amount of the first patterned electrodes 24 is two, which is an example. At least two second patterned electrodes 26 are arranged over the opening chambers 12 and arranged on the vibration block 22. The amount of the second patterned electrodes 26 is two, which is an example. The first and second patterned electrodes 24 and 26 are arranged over different regions of a conduction surface of the conduction layer 16. The first and second patterned electrodes 24 and 26 are spaced in a plane parallel to the conduction layer 16. A first gap D3 or D3' exists between the second patterned electrode 26 and the neighboring first patterned electrode 24. The second patterned electrodes 26 and the inside first patterned electrode 24 can form a first capacitor 46, and the second patterned electrodes 26 and the outside first patterned electrode 24 can form a second capacitor 48. When the vibration block 22 vibrates, the vibration block 22 moves the second patterned electrodes 26 the second patterned electrodes 26 and the first patterned electrodes 24.

The conduction layer 16 further comprises a supporting block 50 arranged between the insulation surface 14 and the insulation layer 18. The vibration block 22 is arranged on the insulation surface 14 and over the opening chambers 12, and the vibration block 22 and the supporting block 50 are independent to each other. Each first patterned electrode 24 comprises a first electrode block 28 and a second electrode block 30 adjacent to each other. The first electrode block 28 is arranged on the insulation layer 18, and the second electrode block 30 is arranged over the vibration block 22. One second electrode block 30 is arranged outside another second electrode block 30, and the second patterned electrodes 26 are uniformly arranged between the second electrode blocks 30.

When the sound pressure applies on the vibration block 22 and the vibration block 22 vibrate up and down, the vibration block 22 moves the second patterned electrodes 26. For example, when the vibration block 22 vibrates up, the first gap D3 between the inside second electrode block 30 and the second patterned electrodes 26 will be reduced, and the first gap D3' between the outside second electrode block 30 and the second patterned electrodes 26 will be enlarged. As a result, the capacitances of the capacitors 46 and 48 are respectively enlarged and reduced. When the vibration block 22 vibrates down, the first gap D3 between the inside second electrode block 30 and the second patterned electrodes 26 will be enlarged, and the first gap D3' between the outside second electrode block 30 and the second patterned electrodes 26 will be reduced. As a result, the capacitances of the capacitors 46 and 48 are respectively reduced and enlarged. The variation of the first gap can affect the capacitances of the microphone. In other words, when the first gap D3 or D3' is reduced, the area of the first patterned electrodes 24 or the second patterned electrodes 26 is slightly enlarged, which results in a very large capacitance. The present invention can greatly save the fabrication cost for large area electrodes.

Figure 12:
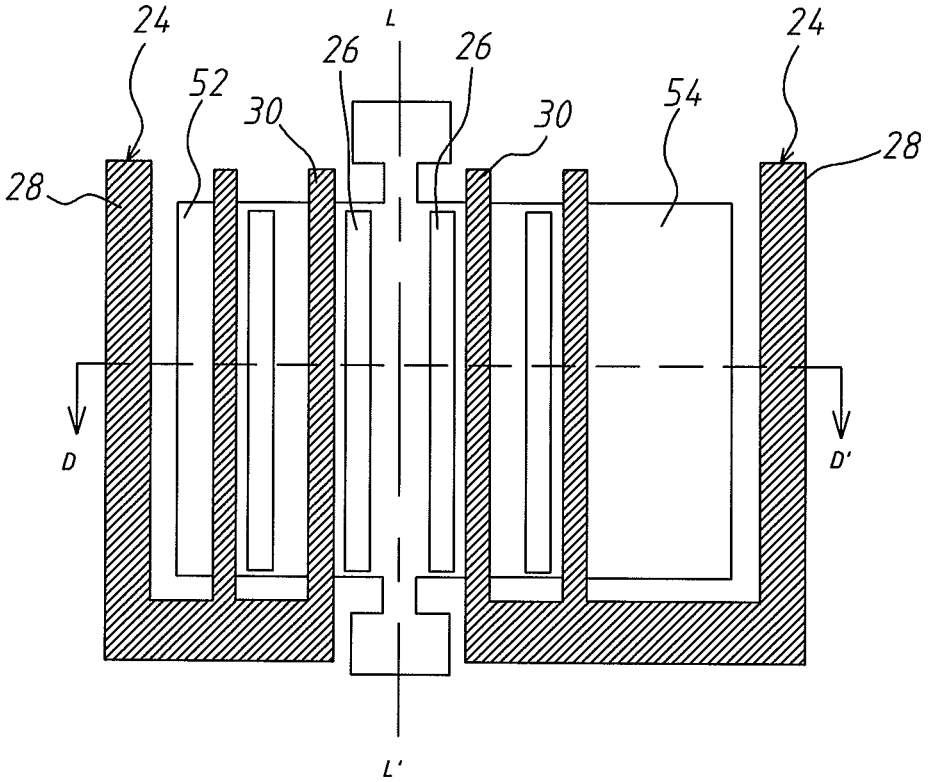
FIG. 12 is a top view schematically showing a microphone structure according to the sixth embodiment of the present invention.
Figure 13:
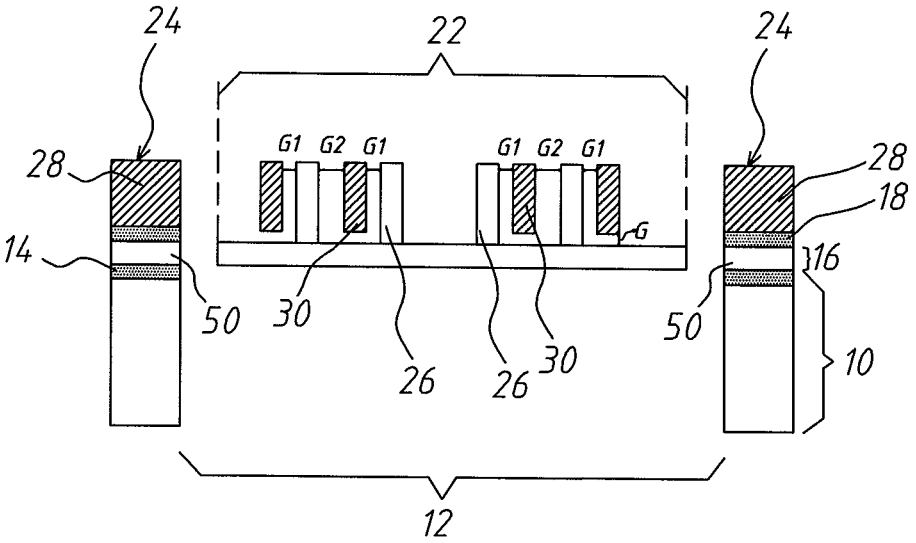
FIG. 13 is a sectional view taken along Line D-D' of FIG. 12 according to the sixth embodiment of the present invention.

Refer to FIG. 12 and FIG. 13. FIG. 12 is a top view schematically showing a microphone structure according to the sixth embodiment of the present invention. FIG. 13 is a sectional view taken along Line D-D' of FIG. 12. The sixth embodiment of the present invention is described below. The sixth embodiment comprises a substrate 10, such as a silicon substrate, penetrated with one opening chamber 12 and having an insulation surface 14. A conduction layer 16 is arranged on the insulation surface 14 and arranged over the opening chamber 12. An insulation layer 18 is arranged on the conduction layer 16 and has a first opening to expose a part of the conduction layer 16 as a vibration block 22 arranged over the opening chamber 12. At least two first patterned electrodes 24 are arranged on the insulation layer 18 and arranged over the vibration block 22 and the opening chamber 12. The amount of the first patterned electrodes 24 is two, which is an example. At least two second patterned electrodes 26 are arranged over the opening chamber 12 and arranged on the vibration block 22. The amount of the second patterned electrodes 26 is four, which is an example. The first and second patterned electrodes 24 and 26 are arranged over different regions of a conduction surface of the conduction layer 16. The first and second patterned electrodes 24 and 26 are spaced in a plane parallel to the conduction layer 16. A first gap exists between the second patterned electrode 26 and the neighboring first patterned electrode 24. When the vibration block 22 vibrates, the vibration block 22 moves the second patterned electrodes 26 whereby the second patterned electrodes 26 and the first patterned electrodes 24 perform differential sensing.

The conduction layer 16 further comprises a supporting block 50 arranged between the insulation surface 14 and the insulation layer 18. The vibration block 22 and the supporting block 50 are independent to each other. The first patterned electrodes 24 are respectively arranged at two opposite sides of a line L-L', and the second patterned electrodes 26 are respectively arranged at two opposite sides of the line L-L'. Each first patterned electrode 24 comprises a first electrode block 28 and a second electrode block 30 adjacent to each other. The first electrode block 28 is arranged on the insulation layer 18, and the second electrode block 30 is arranged over the vibration block 22. The first patterned electrodes 24 are symmetrical with the line L-L', and the second patterned electrodes 26 respectively neighbor the second electrode blocks 30, and the second patterned electrodes 26 are symmetrical with the line L-L'. The second patterned electrodes 26 and the second electrode blocks 30 are interlaced arranged. A first and a second gaps G1 and G2 exist among the two second patterned electrodes 26 and the second electrode block 30 therebetween. The second electrode block 30 is separated from the neighboring second patterned electrode 26 by the first gap G1. The second gap G2 is larger than the first gap G1. The vibration block 22 further comprises a first sub-vibration block 52 and a second sub-vibration block 54 which are adjacent to each other and respectively arranged at two opposite sides of the line L-L'. The first sub-vibration block 52 and the second sub-vibration block 54 are asymmetrical. When the sound pressure applies on the vibration block 22, the first sub-vibration block 52 and the second sub-vibration block 54 exercise, which is used to sense the magnitude of the sound pressure.

When the sound pressure applies on the vibration block 22 and the vibration block 22 vibrate up and down, the vibration block 22 moves the second patterned electrodes 26. For example, when the vibration block 22 vibrates up, a gap G between the second electrode block 30 and the conduction layer 16 will be reduced. When the vibration block 22 vibrates down, the gap G between the second electrode block 30 and the conduction layer 16 will be enlarged. The variation of the gap G can affect the capacitance of the microphone and the capacitance between the second patterned electrode 26 and the second electrode block 30. In other words, when the gap G is reduced, the area of the first patterned electrodes 24 or the second patterned electrodes 26 is slightly enlarged, which results in a very large capacitance. The present invention can greatly save the fabrication cost for large area electrodes.

Figure 14:
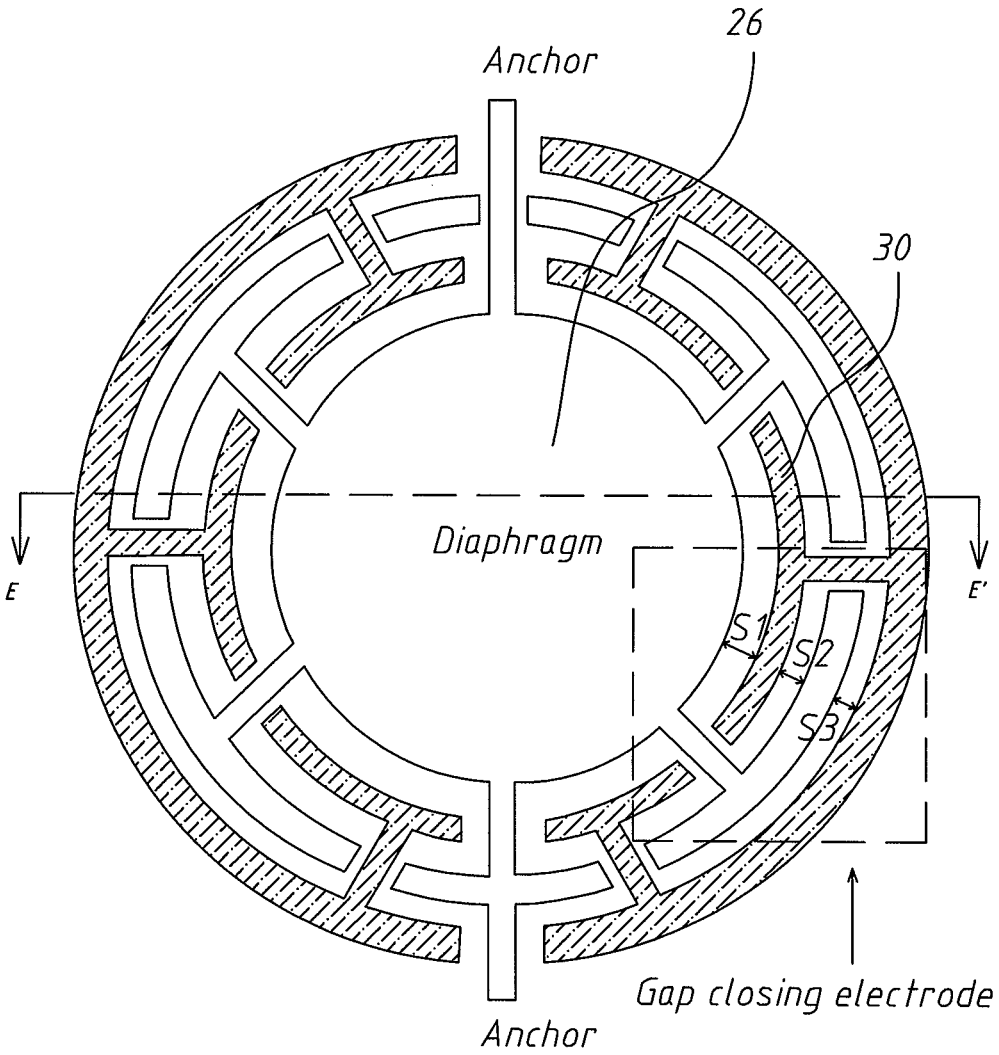
FIG. 14 is a top view schematically showing a microphone structure according to the seventh embodiment of the present invention.
Figure 15:
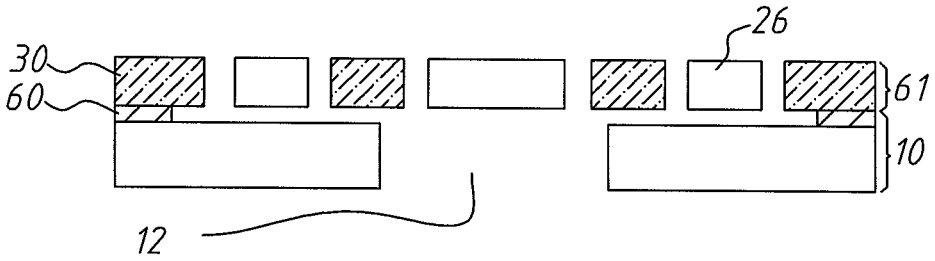
FIG. 15 is a sectional view taken along Line E-E' of FIG. 14 according to the seventh embodiment of the present invention.

Refer to FIG. 14 and FIG. 15. FIG. 14 is a top view schematically showing a microphone structure according to the seventh embodiment of the present invention. FIG. 15 is a sectional view taken along Line E-E' of FIG. 14. The seventh embodiment of the present invention is described below. The seventh embodiment comprises a substrate 10 penetrated with an opening chamber 12 and having an insulation surface 60. The insulation surface 60 is made of silicon oxide and the substrate 10 is exemplified by a silicon substrate. An electrode layer 61 is disposed on the insulation surface 60. The electrode layer 61 includes at least a second patterned electrode 26 and at least a second electrode block 30 for performing gap-closing sensing. The second patterned electrode 26 is used as a diaphragm, and the second patterned electrode 26 and the second electrode block 30 are separated by at least two different co-planar gaps connecting with the opening chamber 12. The potential of the second patterned electrode 26 is different from the potential of the second electrode block 30. The second patterned electrode 26 denotes a rotor electrode, while the second electrode block 30 denotes a stator electrode. The portion of the second patterned electrode 26 is used as a vibration diaphragm, and is located inside the second silicon block 30.

The stator electrode and the rotor electrode are separated by co-planar gaps S1, S2, and S3, to form horizontal type capacitor structure, while the co-planar gaps S1, S2, and S3 are for example 1.5 μm, 3 μm, and 1.5 μm respectively. In other words, when a voltage is applied between the stator electrode and the rotor electrode to perform acoustic pressure sensing, the sensor electrode of the microphone will produce capacitance variations, and the capacitance sensing is referred to as gap closing sensing. Its structure is simpler, capable of saving quite a few production steps, as compared with the ordinary capacitor type microphone requiring vertical type capacitor structure of diaphragm, backplane, and chamber.

In conclusion, the present invention uses the simple fabrication process to save the fabrication cost of the microphone with a large capacitance.

The above detailed description of the preferred embodiment is intended to describe more clearly the characteristics and spirit of the present invention. However, the preferred embodiments disclosed above are not intended to be any restrictions to the scope of the present invention. Conversely, its purpose is to include the various changes and equivalent arrangements which are within the scope of the appended claims.

What is claimed is:

1. A microphone structure, comprising:

a substrate penetrated with at least one opening chamber and having an insulation surface;

a conduction layer arranged on said insulation surface and arranged over said opening chamber;

an insulation layer arranged on said conduction layer and having a first opening to expose a part of said conduction layer as a vibration block arranged over said opening chamber;

at least two first patterned electrodes arranged on said insulation layer and arranged over said vibration block; and at least two second patterned electrodes arranged over said opening chamber and arranged on said vibration block, and said first and second patterned electrodes are disposed on different regions of a same side of a conduction surface of said conduction layer, and a first gap exists between said second patterned electrode and neighboring said first patterned electrode, and when said vibration block vibrates, said vibration block moves said second patterned electrodes whereby said second patterned electrodes and said first patterned electrodes perform differential sensing, wherein the second patterned electrodes are disposed directly on said conduction layer.

2. The microphone structure as claimed in claim 1, wherein each said first patterned electrode comprises a first electrode block and a second electrode block adjacent to each other, and said first electrode block is arranged on said insulation layer, and said second electrode block is arranged over said vibration block, and said first patterned electrodes are symmetrical with a line being an axis, and said second patterned electrodes respectively neighbor said second electrode blocks, and said second patterned electrodes are symmetrical with said axis.

3. The microphone structure as claimed in claim 1, wherein said first patterned electrodes are arranged over said opening chamber.

4. The microphone structure as claimed in claim 1, wherein said conduction layer further comprises at least two first supporting blocks arranged between said insulation surface and said insulation layer, and said vibration block further comprises at least two sensed blocks, a diaphragm block, at least two second supporting blocks and at least two moved blocks, and said diaphragm block, said second supporting blocks and said moved blocks are adjacent to each other, and said moved blocks and said second supporting blocks are arranged outside said diaphragm block, and said second supporting blocks are arranged on said insulation surface, and said diaphragm block is arranged over said opening chamber, and said first supporting blocks and said sensed blocks are respectively adjacent to each other, and said first supporting blocks are respectively arranged outside said sensed blocks, and said moved blocks and said sensed blocks are arranged over said opening chamber, and said moved blocks are respectively separated from said sensed blocks by at least one second gaps, and said first patterned electrodes are arranged on said insulation layer and said sensed blocks, and said second patterned electrodes are arranged on said moved blocks, and said diaphragm block vibrates to move said second patterned electrodes.

5. The microphone structure as claimed in claim 1, wherein said at least one opening chamber is at least two opening chambers, and said conduction layer further comprises a supporting block arranged between said insulation surface and said insulation layer, and said vibration block is arranged on said insulation surface and over said opening chambers, and said vibration block and said supporting block are independent to each other, and each said first patterned electrode comprises a first electrode block and a second electrode block adjacent to each other, and said first electrode block is arranged on said insulation layer, and said second electrode block is arranged over said vibration block, and one said second electrode block is arranged outside another said second electrode block, and said second patterned electrodes are uniformly arranged between said second electrode blocks.

6. The microphone structure as claimed in claim 1, wherein said substrate is a silicon substrate.

7. The microphone structure as claimed in claim 2, wherein each said second electrode block further comprises at least five second openings to expose said vibration block.

8. The microphone structure as claimed in claim 2, wherein said at least two first patterned electrodes are four said first patterned electrodes.

9. The microphone structure as claimed in claim 4, wherein said sensed blocks are symmetrical with a line being an axis, and said moved blocks are symmetrical with said axis.

10. A microphone structure, comprising:

a substrate penetrated with at least one opening chamber and having an insulation surface;

a conduction layer arranged on said insulation surface and arranged over said opening chamber;

an insulation layer arranged on said conduction layer and having a first opening to expose a part of said conduction layer as a vibration block arranged over said opening chamber;

at least two first patterned electrodes arranged on said insulation layer and arranged over said vibration block; and at least two second patterned electrodes arranged over said opening chamber and arranged on said vibration block, and said first and second patterned electrodes are disposed on different regions of a same side of a conduction surface of said conduction layer, and a first gap exists between said second patterned electrode and neighboring said first patterned electrode, and said conduction layer further comprises a supporting block arranged between said insulation surface and said insulation layer, and said vibration block and said supporting block are independent to each other, and said first patterned electrodes are respectively arranged at two opposite sides of a plane, and said second patterned electrodes are respectively arranged at said sides of said plane, and said vibration block further comprises a first sub-vibration block and a second sub-vibration block which are adjacent to each other and respectively arranged at said sides of said plane, and said first sub-vibration block and said second sub-vibration block are asymmetrical, and when said vibration block vibrates, said vibration block moves said second patterned electrodes whereby said second patterned electrodes and said first patterned electrodes perform differential sensing, wherein said plane is perpendicular to said conduction layer.

11. A microphone structure, comprising:

a substrate penetrated with an opening chamber and having an insulation surface; and an electrode layer, disposed on said insulation surface, a silicon layer that includes at least a second patterned electrode and at least a second electrode block for performing gap-closing sensing, wherein the at least one second patterned electrode is disposed inside the second electrode block, said second patterned electrode is used as a diaphragm, and said second patterned electrode and said second electrode block are separated by at least two different co-planar gaps connecting with said opening chamber.

* * * * *